United States Patent [19]

Marshall

[11] Patent Number: 4,768,775

[45] Date of Patent: Sep. 6, 1988

[54] COMBINATION ROWING MACHINE AND CHEST EXERCISER

[75] Inventor: Frank E. Marshall, 3121 SW. Moody Ave., Portland, Oreg. 97210

[73] Assignee: Frank E. Marshall, Portland, Oreg.

[21] Appl. No.: 72,642

[22] Filed: Jul. 13, 1987

[51] Int. Cl.[4] ..... A63B 69/06; A63B 21/00

[52] U.S. Cl. ..... 272/72; 272/130; 272/134

[58] Field of Search ..... 272/72, 130,134, 146; 403/328, 108, 325

[56] References Cited

U.S. PATENT DOCUMENTS

| | | | |
|---|---|---|---|
| 1,577,809 | 3/1926 | Randall | 272/72 |
| 4,113,221 | 9/1978 | Wehner | 403/328 X |
| 4,477,071 | 10/1984 | Brown et al. | 272/134 X |
| 4,550,908 | 11/1985 | Dixon | 272/130 |
| 4,621,623 | 11/1986 | Wang | 272/72 |
| 4,627,610 | 12/1986 | Ishida et al. | 272/72 |
| 4,629,185 | 12/1986 | Amann | 272/72 X |

FOREIGN PATENT DOCUMENTS

| | | | |
|---|---|---|---|
| 462510 | 1/1914 | France | 403/328 |

*Primary Examiner*—Richard J. Apley
*Assistant Examiner*—Franklin L. Gubernick
*Attorney, Agent, or Firm*—Robert L. Harrington

[57] ABSTRACT

An exercising apparatus of the rowing type having a seat freely slidable on a rail, feet stirrups, and poles representing oars that are provided with one-way resistance. With these features, the apparatus is usable as a conventional rowing-type machine. It is convertible to alternate use by the additional features as follows: the seat is provided with a backrest and the seat is reversible on the rail. The poles are pivoted front to back, the resistance being applied in one of these directions only, and are further freely pivotable side-to-side. The seat is locked in place in its reversed position so that the poles can be moved by the user between a position with the arms extended to the sides and the arms extended to the front. Such movement is resisted on the side-to-front motion only.

4 Claims, 2 Drawing Sheets

COMBINATION ROWING MACHINE AND CHEST EXERCISER

FIELD OF INVENTION

This invention relates to an apparatus used primarily as a rower-type exercising apparatus that is convertible to an alternate type of exercise.

BACKGROUND OF THE INVENTION

Rower-type exercising apparatus are commonly found in exercising salons and homes. Briefly, the apparatus includes a seat freely slidable on a rail. Stirrups are fixed to one end of the rail. Poles representing rowing oars are pivotally anchored at each side of the rail with resistance against pivoting in the direction away from the stirrups. A user sits in the seat facing the stirrups with his feet in the stirrups and his hands on the free end of the poles. He moves the seat back and forth on the rail by bending and straightening his knees. The poles are pivoted toward the stirrups without resistance and pivoted away from the stirrups with a resistive action that simulates rowing.

One of the problems that the rowing apparatus and other types of exercising apparatus have is that the exercising activity of any one apparatus is limited. It is well known that it is preferable to vary the form of exercise. Yet each apparatus by itself is somewhat cumbersome and to have multiple exercising apparatus in one's home is expensive and creates a space problem.

An obvious answer is the provision of multiple exercising stations on the same apparatus. One or both of two things invariably takes place. The primary action intended for the apparatus is compromised and/or additional equipment is added such as poles, pulleys or whatever. The result is that such apparatus is substantially more cumbersome and thus more awkward to set up and operate.

BRIEF SUMMARY OF THE INVENTION

The present invention provides a rower-type exercising apparatus with features that optimize the rowing action. A backrest is provided that might otherwise be omitted but is a minor addition and does not detract from the rowing action. Yet the apparatus can be converted to exercise a completely different set of muscles by the simple function of turning the seat 180 degrees and locking it to the rail. The backrest on the seat replaces the stirrups in providing a stop or anchor for the user. The user simply pulls the poles from an extended side position to a forward position against the resistance, to be freely returned unopposed to the side position, and so on. This resembles the exercise provided by the common "rope pull".

The invention will be more clearly understood by reference to the following detailed description and drawings referred to, wherein.

Figure 4:
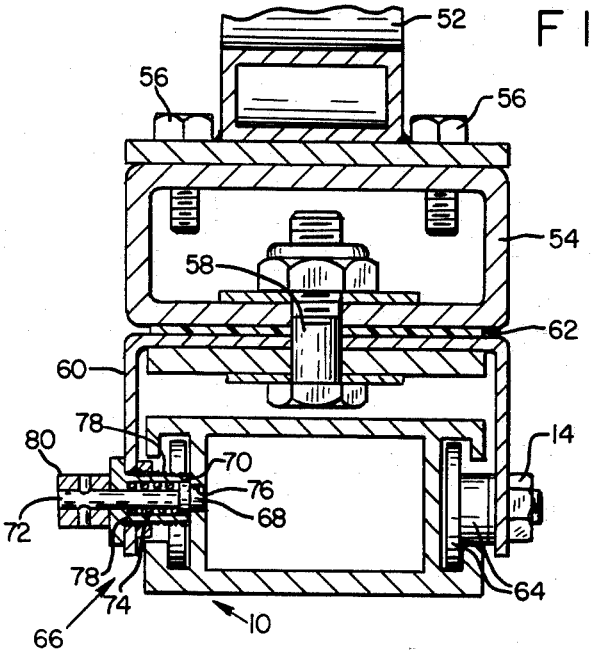
FIG. 4 is a section view taken on section line 4—4 of FIG. 2.

With reference to the drawings, the apparatus has a rail 10 that is essentially a long rigid bar with side grooves 12 configured to accommodate bearing rollers of a seat assembly 16. (The bearing rollers are identified in the drawings as fastened to the seat assembly by fastening nut 14.) The rail is supported at one end (referred to herein as the rear end) by a support pad 18. A front crossbar 20 is affixed to the underside of rail 10 and supports the front end. A pair of stirrups 22 are attached to the crossbar 20 at each side of the rail 10. At an intermediate position rearward of crossbar 20 (about one-third the distance back), a second crossbar 24 is affixed to the underside of the rail 10. A rod 26 extends between the crossbars 20 and 24 at each side of the rail. Rods 26 extend through bearing holes 27 in the crossbars and are mounted for pivoting about the longitudinal axis of the rod. A pair of front brackets 28 are mounted on the front ends of the rods 26 and a pair of rear brackets 30 are mounted on the rear ends of the rods 26.

Poles 32, representing rowing oars, are mounted on brackets 30 for pivoting about pivor 34. A slidable clamp 36 is slidably mounted on the pole 32. As indicated by arrow 38 the clamp can be moved up and down the pole. A lock 40 releases and locks the clamp 36 within a range of desired positions.

Extended between the clamp 36 and the front bracket 28 is an air cylinder 42. The air cylinder is of conventional design and accordingly allows easy relative movement of cylinder rod 44 into the cylinder 42 but resists movement of the cylinder rod 44 out of the cylinder 42. The connection of the cylinder to the bracket 28 is a pivotal connection at pivot 46 that allows the angular shifting of the cylinder 42 and cylinder rod 44 with the sliding of clamp 36 up and down on pole 82.

It will be appreciated that the entire assembly of rear bracket 30, front bracket 28, cylinder 42 and pole 32, are all fixed to rod 26. By reason of rod 26 being pivoted about its longitudinal axis, the assembly is similarly pivoted about that axis. This pivoting of the pole and cylinder is illustrated in dash lines in FIGS. 1 and 3. (A cover 46 encloses the rod 26 for aesthetic purposes only.)

Figure 2:
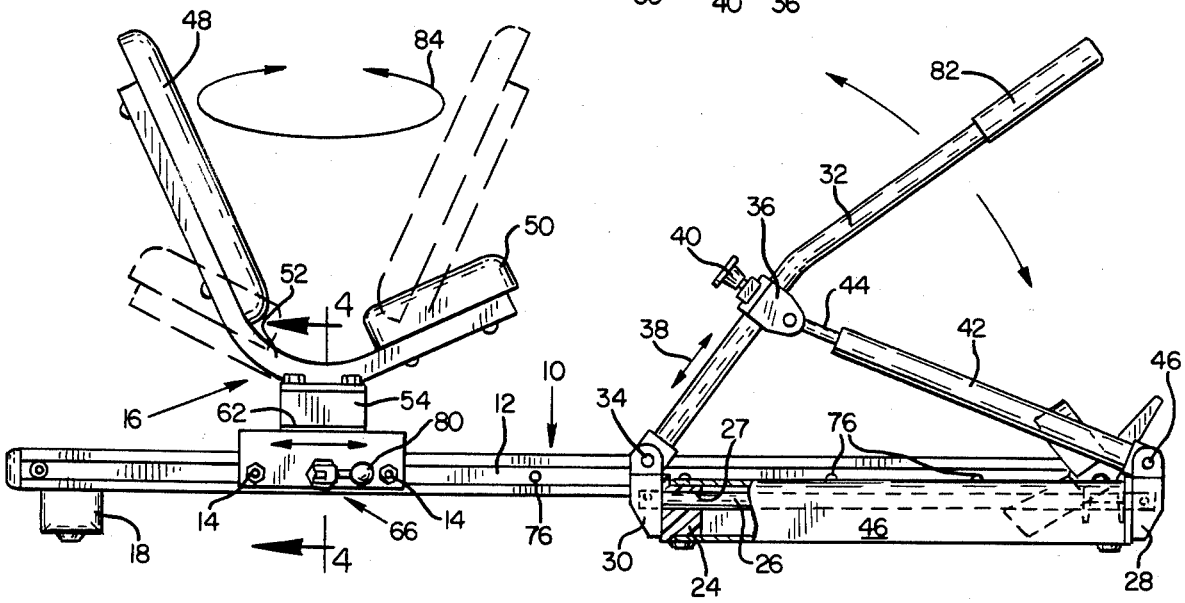
FIG. 2 is a side view of the apparatus of FIG. 1.
Figure 3:
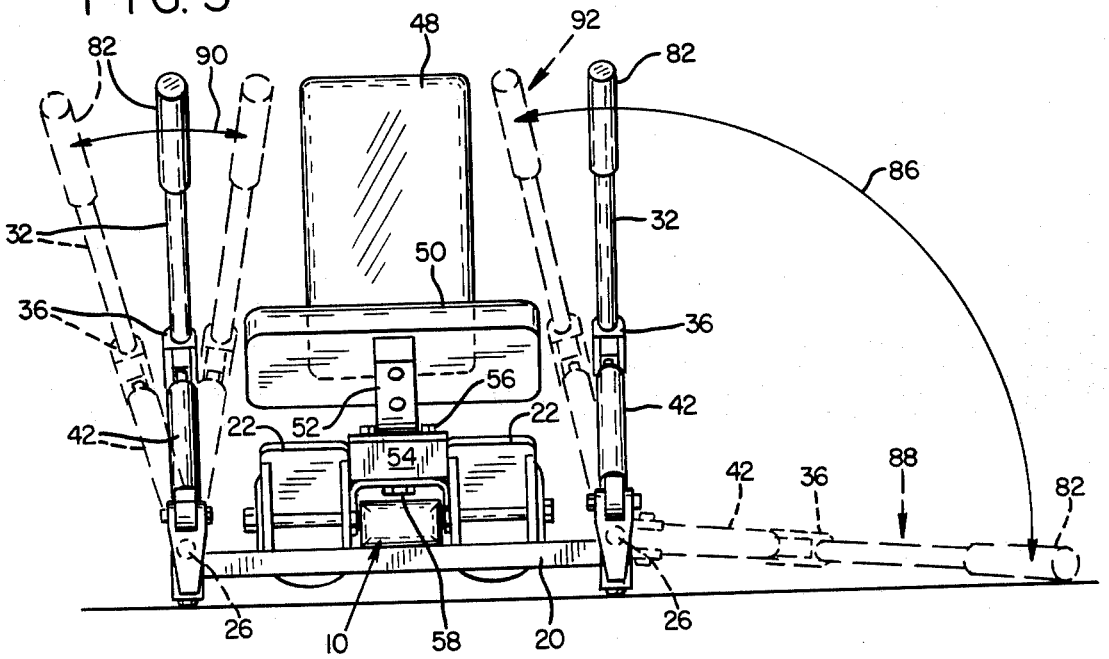
FIG. 3 is a front view of the apparatus of FIG. 1.

The seat assembly is most clearly illustrated in FIGS. 2, 3, and 4. As shown, seat assembly 16 includes a backrest 48, a seating pad 50, and rigid support brace 52. The support brace 52 is secured by bolts 56 to a mounting cup 54.

Reference is now made to FIG. 4. The mounting cup 54 is bolted by a center bolt 58 to an inverted U-bracket 60. A low friction bearing pad 62 is provided between the cup 54 and U-bracket 60 and the bolt connection is provided to allow rotation of the cup 54 and the seat assembly 16 relative to U-bracket 60, i.e., around the axis of the bolt 58.

U-bracket 60 carries four bearing rollers (indicated by fasteners 14). The bearing rollers project from the legs of the U-bracket into the grooves 12 of the rail 10. As will be seen in FIG. 4, low friction roller disk members 64 of the bearing rollers mate with the configuration of grooves 12 to provide free sliding of the seat assembly along the rails while trapping the roller disk members in the rail grooves. (Note that only the bearing roller on the right leg of U-bracket 60 is fully shown because of the lock mechanism 66 which covers up the bearing roller for the left leg.)

The lock mechanism 66 includes a pin 68 that is adapted to project into any of a plurality of holes 76 in slide rail 10. A spring 74 inside collar 78 (which collar 78 is secured in the leg of the U-bracket) acting against shoulder 70 of the pin urges the pin into engagement with the rail holes 76. The shoulder 70 slides inside the collar between two positions, the outer position being illustrated with the projected portion only extended from the collar and into the hole. In the retracted position the projected portion is withdrawn into a position inside the collar. A lever 80 is of the cam-type that is pivoted to one side, to allow the spring tension to force projection of pin 68 into the hole, and is pivoted to the other side, to compress the spring and withdraw the pin. Obviously with the lever 80 positioned to allow projection of the pin, the pin will seek a rail hole to lock the seat assembly in fixed position on the rail. In the dash line position the seat assembly is free to slide on the rail.

OPERATION

Figure 1:
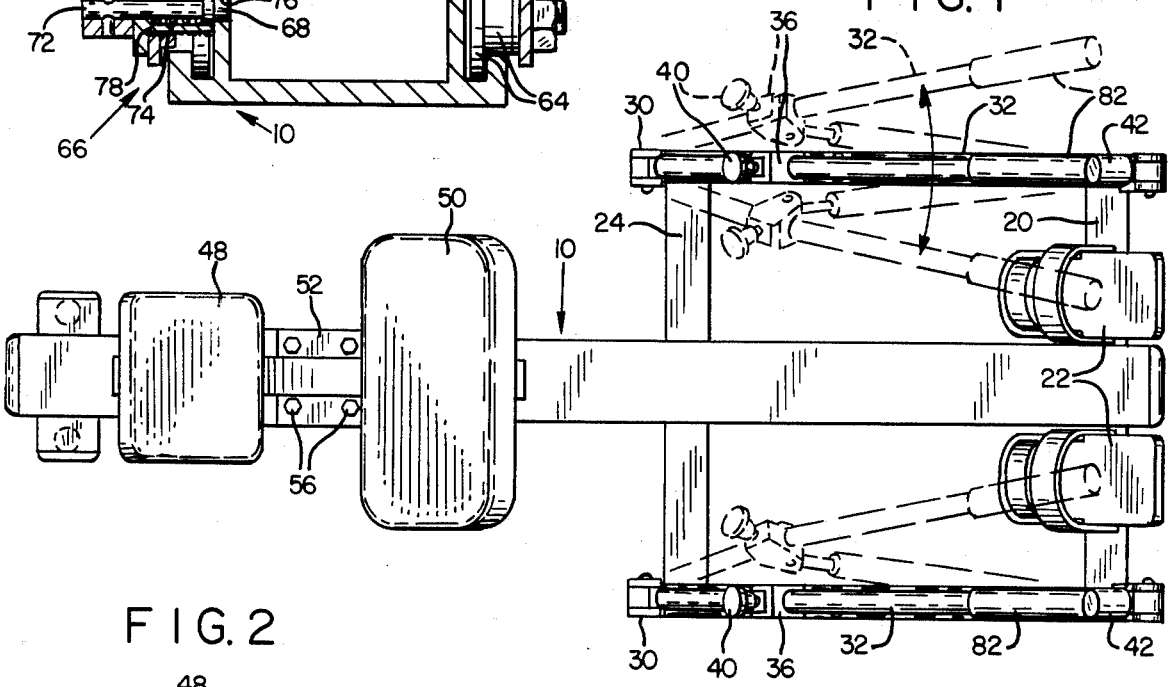
FIG. 1 is a top view of an exercise apparatus in accordance with the present invention.

FIGS. 1, 2, and 3 illustrate the apparatus in position for rowing exercise. The lever 80 must of course be pivoted to cause withdrawal of the pin and free sliding of the seat on the rail. A user sits on the seat 50 with his back toward backrest 48 and his feet in stirrups 22. Handles 82 are gripped and the user pushes against the stirrups while hanging onto the poles, thereby pulling the poles rearward against the resistance of cylinder 42. The seat 16 freely slides backward until the user's legs have been fully extended. He then leans forward while bending his knees to draw the seat and poles, without resistance, to the forward position. The cycle is then repeated ad infinitum. Should the user desire greater or lesser resistance on the pulling stroke of the cycle, clamp 36 is moved up (for greater pressure) or down as desired.

The above is standard for the operation of a rowing machine. The only features not previously common to rowing machines are the swiveling seat with its backrest and locking mechanism. The poles being pivoted about the axis of rod 26 is a feature that may be excluded from prior rowing machines but is a desirable feature. However it is essential to the "alternate" exercising function and thus may be viewed as a further feature not common to rowing machines.

To convert the rowing machine, one need only turn the seat on its axis through bolt 58 (FIG. 4) to the dash position of FIG. 2, the turning being indicated by arrow 84, and then pivot the lever 80 to its locking position. The user will however want to determine the desired position of the seat along the rail 10 before releasing the lock mechanism. Whereas it is likely that eyeballing will not precisely align the pin 68 with the selected rail hole 76, the pin when released will be urged by the spring 74 to seek entry into the first hole with which it becomes aligned. The seat is thus simply cautiously moved along the rail until the pin is aligned with the desired locking hole and the spring pressure does the rest.

Figure 5:
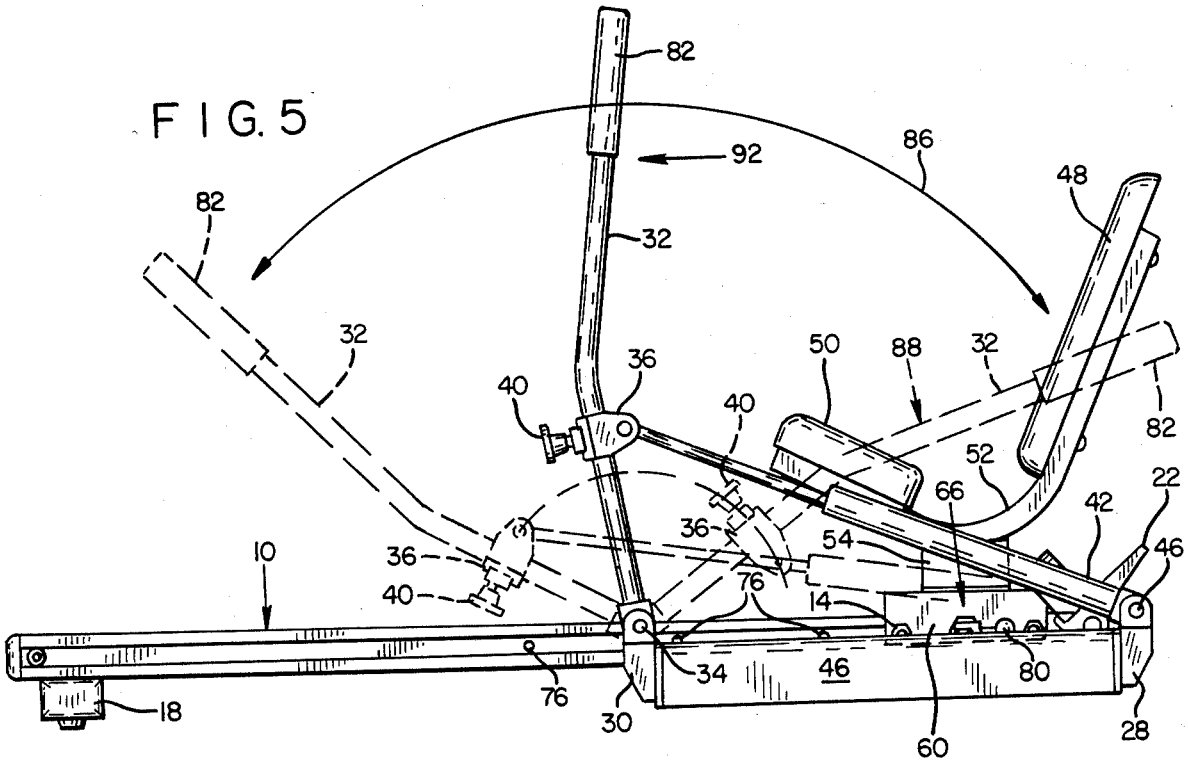
FIG. 5 is a view illustrating the apparatus of FIG. 1 in its alternate use position.

The converted or alternate position is illustrated in FIG. 5. With his back against backrest 50, a user grips the handles and draws the poles to his side with his arms extended. The poles will be pivoted both rearwardly on pivot 34 and sidewardly about the axis of rod 26. This combination forward and sideward movement is indicated in general by arrow 86 and by the dash position 88 of both FIGS. 3 and 4. However, it is to be understood that the various dash line positions and the "movement" arrows of the Figures indicate various movements and positions of the poles 32 as permitted by the coupling of the pivots 34, 36 and 26.

The user pulls his arms in an arc, from his sides to an extended position in front, e.g. the position indicated by reference 92. The pivoting of the poles about rod 26 is not resisted but the forward pivoting about pivot 34 is resisted. Again the resistance can be adjusted by moving clamp 26 up or down on the pole. The user simply repeats the front to side, side to front extended movement of his arms to exercise a variety of back, arm and chest muscles, much in the manner of the rope pull exercise common to exercising salons.

The invention is believed to produce a significant benefit by substantially improving the range of muscles that can be exercised with little more than the features standard to a rowing machine. Others will conceive of variations and improvements derived from the above description, and the invention is not limited thereby, but rather is encompassed by the definition of the accompanying claims.

I claim:

1. An exercising apparatus comprising; a rail, a seat assembly having a seat and mounted on the rail for free sliding movement there along, foot stirrups fixed to one end of the rail and determining the front end direction of the apparatus whereby a user sitting in the seat with his feet in the stirrups can move the seat assembly in reciprocating motion along the rail by bending and extending his knees, a pole at each side of the rail pivotally attached to the rail for pivoting in a direction along the rail length, and one-way resistance means connected to each pole for resisting pivoting of the poles in one direction, and handle portions on the poles to be gripped by the user to pivot the poles in reciprocating motion with reciprocating motion of the sliding seat assembly, and the improvement that comprises;

said seat assembly mounted on the rail through a mounting bracket, said mounting bracket being slidably mounted on the rail, locking means for locking the mounting bracket to the rail, and said poles being further pivotable about an axis parallel to the rail, and said seat assembly including a seat and a backrest, the combination seat and backrest defining a sitting position, swivel mounting means mounting the combination seat and backrest to the mounting bracket to allow rotation of the seat and backrest between back to front and front to back sitting positions relative to the rail, and in conjunction with the locking means converting the exercising apparatus from the rowing type exercise to a side to front arm pull exercise.

2. An exercising apparatus as defined in claim 1 wherein a first crossbar is fastened to the rail at the front end thereof, a second crossbar is fastened to the rail at an intermediate position, and rods mounted between the two crossbars on each side of the rail, said rods being rotatable about a longitudinal axis, the front to back pivotal attachment of the poles being to the rear end of the rods whereby the further pivoting of the poles is provided by the rotation of the rods, and pressure cylinders extended between the poles and attached to the forward end of the rods, said attachment of the poles and cylinders to the rods enabling coordinated side-to-side pivoting of the cylinders with pivoting of the poles, said pressure cylinders providing the one-way resistance means.

3. An exercising apparatus as defined in claim 2 wherein the poles are elongated and extend upwardly from its pivotal attachment to the rail, and the pressure cylinders are connected to the poles with adjustable clamps that adjust the connection up and down on the poles and thereby further away from and closer to the pivotal attachment for increasing and decreasing the resistive force.

4. An exercising apparatus as defined in claim 1 wherein the locking means is provided by a locking pin mounted on the bracket and cooperating locking holes on the rail, spring means for urging movement of the pin toward the rail whereby alignment of the pin with a locking hole effects insertion of the pin into the hole for locking, and manual control means for retracting the pin against the spring urging thereof to maintain the locking means in unlocked position for free sliding of the seat.

* * * * *